US006377189B1

(12) United States Patent
Newman

(10) Patent No.: US 6,377,189 B1
(45) Date of Patent: Apr. 23, 2002

(54) OIL WELL SERVICING SYSTEM

(76) Inventor: Frederic M. Newman, 1618 W. Dengar, Midland, TX (US) 79705

( * ) Notice: Subject to any disclaimer, the term of this patent is extended or adjusted under 35 U.S.C. 154(b) by 0 days.

(21) Appl. No.: 09/281,864

(22) Filed: Mar. 31, 1999

(51) Int. Cl.[7] ..... G01V 3/00

(52) U.S. Cl. ..... 340/854.6; 340/870.1; 340/870.11

(58) Field of Search ..... 340/854.7, 856.3, 340/853.1, 854.6, 870.02, 870.1, 870.11; 181/102; 701/1; 166/245; 73/152.02

(56) References Cited

U.S. PATENT DOCUMENTS

RE36,569 E * 2/2000 Kukes ..... 324/346
4,700,142 A * 10/1987 Kukes ..... 324/346
4,765,435 A * 8/1988 Reichert ..... 181/102
4,884,847 A * 12/1989 Bessinger et al. ..... 388/1
5,218,301 A * 6/1993 Kukes ..... 324/346
5,298,894 A * 3/1994 Cerny ..... 340/870.02
5,438,329 A * 8/1995 Gastouniotis et al. .. 340/870.03
5,617,084 A * 4/1997 Sears ..... 340/870.02
6,006,212 A * 12/1999 Schleich et al. ..... 340/870.02
6,021,093 A * 2/2000 Birchak et al. ..... 367/25
6,087,965 A * 7/2000 Murphy ..... 340/991
6,253,849 B1 * 7/2001 Newman ..... 166/255.1

* cited by examiner

*Primary Examiner*—Michael Horabik
*Assistant Examiner*—Albert K. Wong
(74) *Attorney, Agent, or Firm*—Robert J. Harter

(57) ABSTRACT

A well servicing system includes a vehicle that travels to perform a service operation at several well sites while monitoring and recording data that reflects the performance of the operation at each site, and then associates that data with unique well site identifiers. The information is stored and secured against tampering to provide a reliable record of what work was done at each particular well site.

21 Claims, 5 Drawing Sheets

OIL WELL SERVICING SYSTEM

BACKGROUND OF THE INVENTION

1. Field of the Invention

The invention generally pertains to oil wells and more specifically to a system for servicing oil wells.

2. Description of Related Art

After a well is set up and operating to draw petroleum, water or other fluid up from within the ground, various service operations are periodically performed to maintain the well. Such service operations may include replacing worn parts such as a pump, sucker rods, inner tubing, and packer glands; pumping chemical treatments or hot oil down into the well bore; and pouring cement into the well bore to partially close off a portion of the well (or to shut it down entirely). Since wells are often miles apart from each other, the maintenance or service operations are usually performed by a mobile unit or service vehicle having special onboard servicing equipment suited to perform the work. Some examples of service vehicles include a chemical tank truck or trailer, a cement truck or trailer, a hot-oiler tank truck or trailer, and a portable work-over service rig having a hoist to remove and install well components (e.g., sucker rods, tubing, etc.).

Service vehicles are often owned by a contractor that the well owner hires to service the wells. Typically, the contractor performs the work and invoices the owner. For many service operations, it is difficult for the owner to confirm exactly what work was actually done or how well it was done, without actually witnessing the work while it is in progress. In the case of pumping a chemical treatment down into a well bore, it is virtually impossible to confirm how much chemical was dispensed after the fact. Other examples would include not being able to confirm the temperature or quantity of a hot oil treatment, the quantity and position of replaced sucker rods or tubing, and the torque used in tightening sucker rods or tubing. There are numerous other possible service operations that are difficult to confirm after the work has been reported as having been completed. Unfortunately it is impractical the well owner to travel to the various remote well sites, arrive at the right moment, and wait around until the work is complete. Consequently, the well owner often relies on the integrity of the contractor. However, even the most reputable contractor (e.g., Fred Newman of Midland, Tex.) can make an honest mistake, as it can be difficult to accurately keep a myriad of process data readings in order and correctly associated with the right oil well, especially when they look so similar.

SUMMARY OF THE INVENTION

To avoid the problems and limitations of existing well servicing systems, it is an object of the invention to provide a well servicing system that reliably monitors the performance of a well servicing operation, properly associates the operation to the correct well, and secures the combined results to protect against unauthorized changes or tampering of data.

A second object is to provide a secure record that can be relied upon at a later date to resolve a maintenance problem, resolve a question of theft, or determine the cause of an accident that may have occurred at the well site.

A third object is to provide a well servicing system for use on a mobile well servicing vehicle.

A fourth object is to provide a durable well identification device that stores a digital well identification value without having to maintain the device with a source of electrical power.

A fifth object is to provide a well servicing system that minimizes a temptation for others to improperly alter data.

A sixth object is to provide a well servicing system that lends itself well to a wide variety of processes.

A seventh object is to eliminate much of the paper shuffling that is often associated with an invoice created by several people manually comparing handwritten work reports to purchase orders, contracts, and a myriad of other documents.

These and other objects of the invention are provided by a novel well servicing system that includes a mobile transducer that senses a parameter of a service operation performed at a plurality of well sites, and includes a memory that stores information provided by the transducer with reference to a well site identifier at each well site to associate the information with the proper well site at which the service operation was performed.

DESCRIPTION OF THE PREFERRED EMBODIMENT

Figure 1:
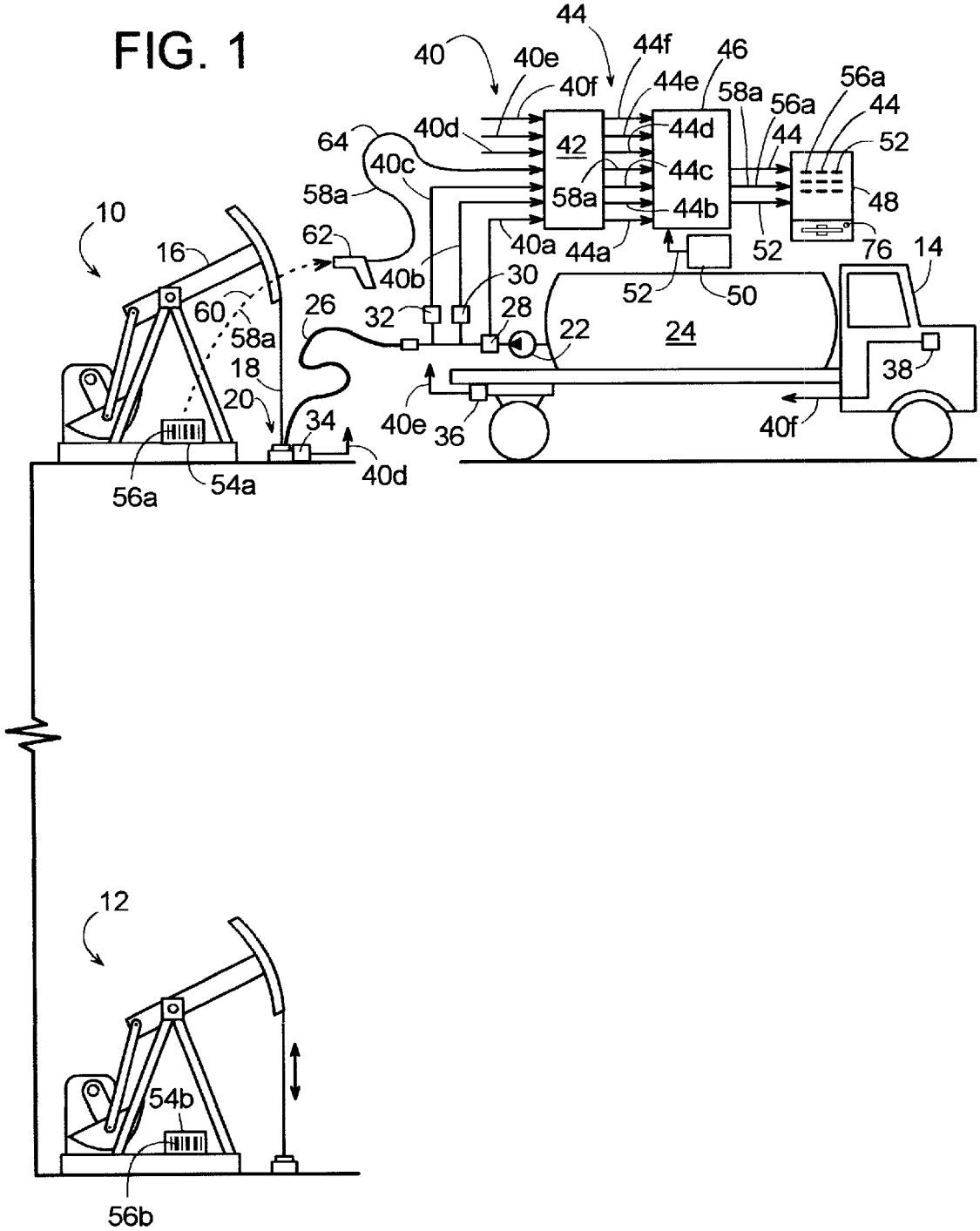
FIG. 1 is a schematic view of a well servicing system, according to one embodiment of the invention, showing a service vehicle at a first well site.
Figure 2:
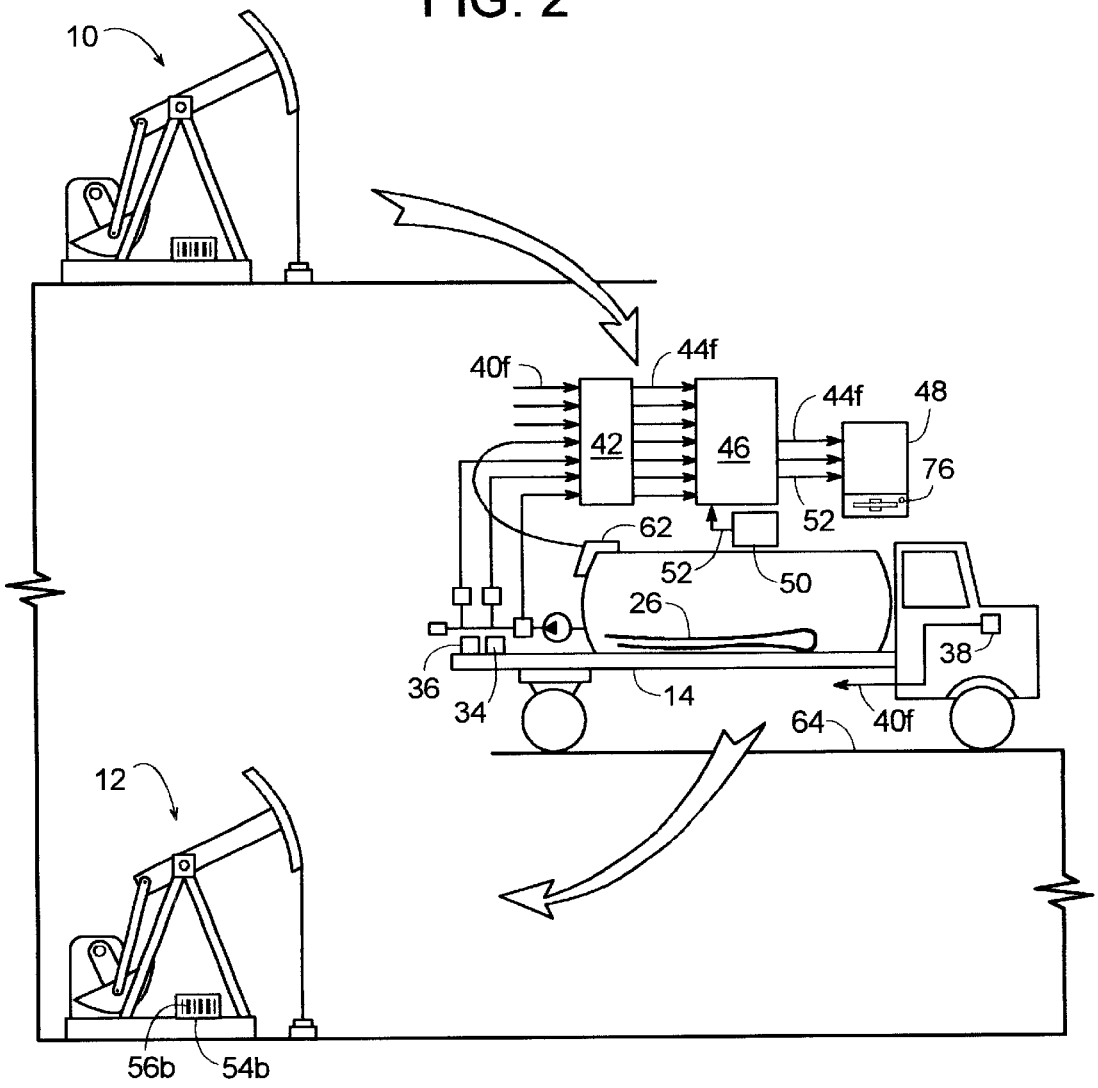
FIG. 2 is another schematic view of the system of FIG. 1, but showing the service vehicle traveling between two well sites.
Figure 3:
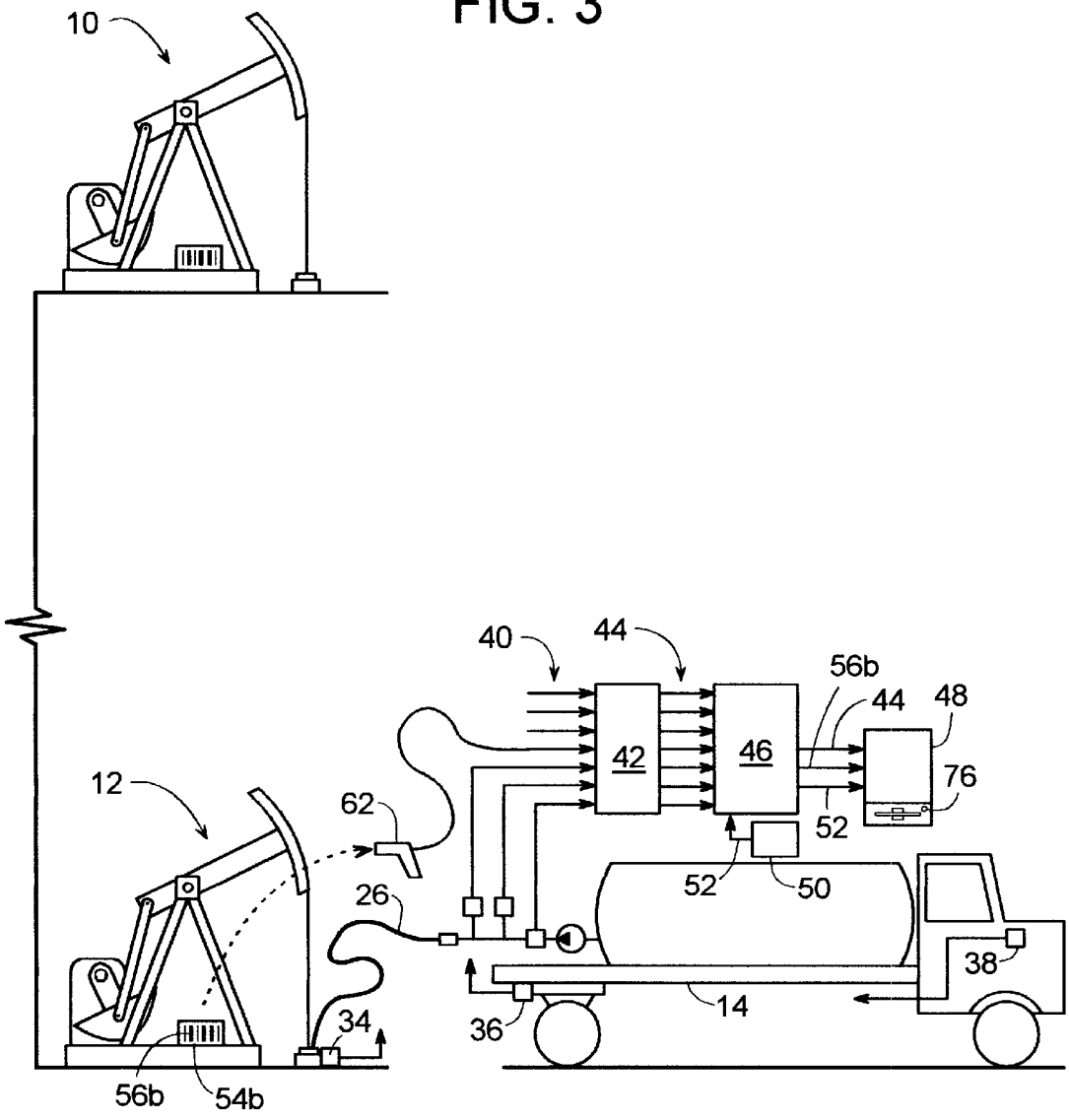
FIG. 3 is the same as FIG. 1, but showing the service vehicle at a second well site.

A first oil well 10 separated several miles from a second oil well 12 are shown in FIGS. 1–3 being serviced by a service vehicle 14. Vehicle 14 is shown servicing well 10 in FIG. 1, servicing well 12 in FIG. 3, and traveling along a road between wells 10 and 12 in FIG. 2. Wells 10 and 12 each includes a pivoting beam 16 that raises and lowers a string of sucker rods 18 to operate a pump submerged deep within a well bore 20.

Once a well is set up and operating to draw petroleum, water or other fluid up from within the ground, various service operations are periodically performed to maintain the well. Such service operations include, but are not limited to, replacing worn parts such as a pump, sucker rods, inner tubing, and packer glands; pumping chemical treatments or hot oil down into the well bore; and pouring cement into the well bore to partially close off a portion of the well (or to shut it down entirely).

Such services are usually performed by an appropriately equipped service vehicle of which some examples would include, but not be limited to, a chemical tank truck or trailer, a cement truck or trailer, a hot-oiler tank truck or trailer, and a portable work-over service rig having a hoist to remove and install well components (e.g., sucker rods, tubing, etc.). All of these examples of service vehicles and more are schematically/generically represented by vehicle 14 of FIGS. 1–3. For example, vehicle 14 includes a pump 22 that pumps a fluid (e.g., hot oil, cement, or chemical) from a tank 24, through a hose 26 and down into well bore 20. The pumping process and a variety of other service operations can be monitored by several transducers that sense various process parameters. The term, "parameter" used in relation to performing a service operation or process on a well represents any detectable feature that reflects at least some condition or status of the process.

For example, for a fluid being pumped (e.g., hot oil, chemical, gas, water, steam, cement, etc.) one transducer 28 monitors the flow rate, a second transducer 30 monitors the pressure, a third transducer 32 monitors the temperature, a fourth transducer 34 (removably attached to the well head) monitors any one of a variety of other parameters, such as fluid acidity or concentration. In some service operations, such as the removal and replacement of sucker rods 18, packer glands, tubing anchors, etc., transducer 34 could count the number of parts being removed or installed to monitor inventory. When replacing sucker rods 18 or other well components, a fifth transducer 36 could monitor the force or weight being applied to vehicle 14 (e.g., a portable work-over service rig having a hoist to remove and install well components). Transducer 36 in conjunction with a sixth transducer 38 monitoring a hoist engine speed could monitor the force and horsepower required to pull a rod 18 from well bore 20.

In response to sensing the various parameters, transducers 28, 30, 32, 34, 36 and 38 provide analog feedback signals 40 (i.e., 40*a*, 40*b*, 40*c*, 40*d*, 40*e* and 40*f* respectively) that an analog to digital converter 42 periodically converts to digital feedback values 44 (i.e., 44*a*, 44*b*, 44*c*, 44*d*, 44*e* and 44*f* respectively). Analog feedback signals typically take the form of voltage (e.g., 0–5 VDC) or current (e.g., 4–20 mA), however other forms of analog feedback could also be used. The term, "digital feedback value" as used throughout this disclosure is equivalent and interchangeable with the term "digital feedback signal" both of which encompass a quantity that if varied, varies in discrete increments. Digital feedback values and digital feedback signals can take a wide variety of forms including, but not limited to, binary voltage, alphanumeric data (e.g., whole numbers, decimals, letters, and combinations thereof, etc.), bar code and magnetic recording. It should be appreciated by those skilled in the art, that incorporating an analog to digital converter within the transducer itself is well within the scope of the invention. In some embodiments of the invention, a conventional microprocessor circuit 46 (well known to those skilled in the art) periodically conveys digital feedback values 44 to a memory 48 where the values are stored. The term, "memory" used herein and below represents any data storage device and its ancillary elements that facilitate its use. Memory 48 is schematically illustrated to represent the wide variety of forms that it can assume, which include, but are not limited to, a hard drive of a computer; a floppy disc; a CD (compact disk); ZIP drive/cartridge, an electronic chip such as RAM, EPROM, or EEPROM and variations thereof; and magnetic tape. In one embodiment, a clock 50 provides a digital time stamp 52 that circuit 46 also conveys to memory 48 to provide digital feedback values 44 with a time reference. Although circuit 46, clock 50 and memory 48 can be provided by any one of a wide variety circuits, in one embodiment, devices 46, 50 and 48 comprise a computer. In another embodiment, however, devices 46, 50 and 48 include a "POCKET LOGGER" by Pace Scientific, Inc. of Charlotte, N.C.

To associate the data collected on the service operation with the particular well on which the work was performed, each well 10 and 12 includes a well identifier 54 (e.g., 54*a*, 54*b*, 54*c* and 54*d*). The term "well identifier" used herein and below represents any value or feature that can be referenced to distinguish one well from another. Some examples of well identifier 54 include, but are not limited to, a bar code label (as commonly used on retail merchandise, e.g., labels 54*a* and 54*b*), data stored on a magnetic or electromagnetic strip (similar to a common credit card or some building access security badges, e.g., item 54*c*), and data stored on an integrated circuit chip (similar to an electromagnetic implant used for animal identification). Other examples of a well identifier include data stored on a memory 54*d* such as a hard drive of a computer; a floppy disc; a CD (compact disk); ZIP drive/cartridge, an electronic chip such as RAM, EPROM, or EEPROM and variations thereof; and magnetic tape.

Information of well identifier 54 preferably takes the form of a digital well site value 56 (e.g., 56*a*, 56*b*, 56*c* and 56*d*). In the example of bar code label 54*a* of FIGS. 1–3, digital well site value 56*a* is represented by a series of bars of varying width and/or pitch. The digital well site value is conveyed to memory 48 by way of a communication link 58 (e.g., 58*a*, 58*b*, 58*c*, 58*d* and 58*e*). In the case of bar code label 54*a*, communication link 58*a* includes a visual scan 60 of label 54*a* by way of a conventional bar code scanner 62 and a cable 64 electrically coupled to memory 48. Well site value 56*a* and digital feedback values 44 are stored in memory 48 in reference to each other, i.e., values 56*a* and 44 can be referenced later in relation to each other, such that one knows which digital feedback values go with which well site value.

In operation then, referring first to FIG. 1, vehicle 14 drives up to well 10, and an operator scans bar code label 54*a*. The scanned digital well site value 56*a* is conveyed to memory 48 by way of communication link 58*a*. The operator connects a hose 26 to well bore 20 and sets up transducers 34 and 36 as shown. Some (or all) of the transducers may already be set up upon arrival of vehicle 14, such as transducers 28, 30, 32 and 38 in this case. The service operation process is performed (e.g., pumping a fluid into well bore 20 through hose 26), while data provided by the transducers is recorded in memory 48 in the form of digital feedback values 44. Clock 50 can provide various time stamps 52 to indicate when vehicle 14 arrived at the site to scan label 54*a*, when the service process began and stopped, when the digital feedback values 44 were sampled, and when vehicle 14 departed.

Upon departing, hose 26, scanner 62, and transducers 34 and 36 can be disconnected and/or stored for transport with vehicle 14. As vehicle 14 travels along a road 64 from well 10 to well 12, as shown in FIG. 2, clock 50, transducer 38 and other transducers could continue to feed memory 48 with data to provide a record of information such as travel time, speed, travel distance, etc., if desired.

Upon arriving at well 12, the setup and operation can proceed as just described in relation to well 10, or an entirely different service operation can be performed, depending upon the service needs of well 12 and the capabilities of service vehicle 14. However, with well 14, the scanned digital value 56*b* of label 54*b* would be different than that of well 10, so that whatever data is collected at well 12 would not be confused with the data that had been gathered and recorded at well 10.

Figure 4:
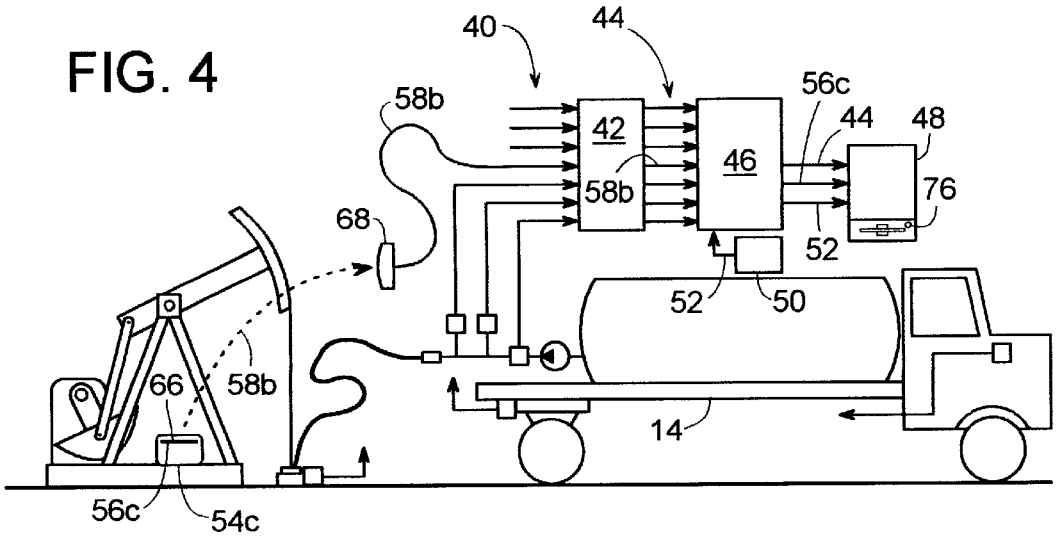
FIG. 4 is a schematic view of another embodiment.

Alternate embodiments of the invention are shown in FIGS. 4–7. In FIG. 4, well site identifier 54*c* includes an electromagnetic element such as magnet strip 66, and communication link 58*b* includes an appropriate electromagnetic detector 68 that senses digital well site value 56*c* of strip 66. Otherwise, the overall operation of the embodiment of FIG. 4 is generally the same as that of FIGS. 1–3.

Figure 5:
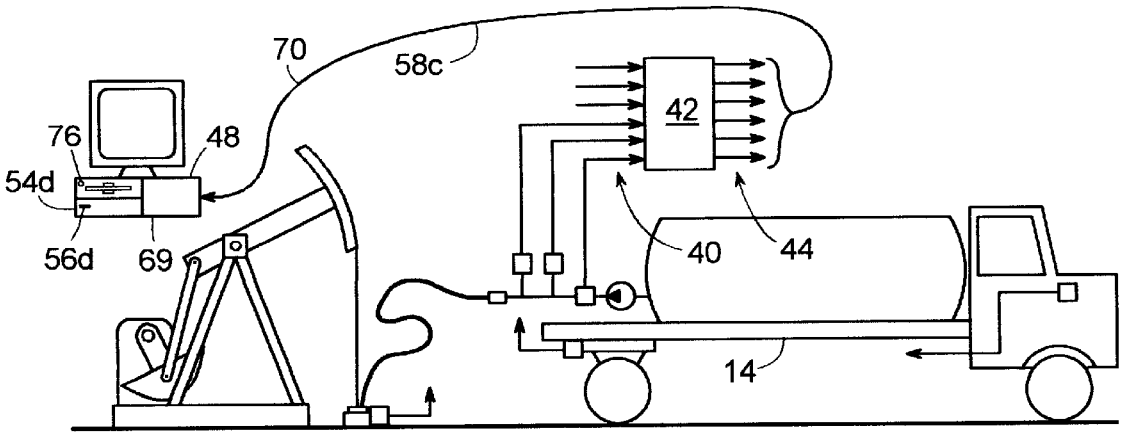
FIG. 5 is a schematic view of another embodiment.

In FIG. 5, the well identifier is memory 54*d* of a computer 69. Memory 54*d* is able to store an entered digital well site value 56*d*. In this example, memory 54*d* and memory 48 are combined. Feedback from the transducers are conveyed to memory 48 by way of communication link 58*c* that includes a readily disconnectable cable 70. Although A/D converter 42 is shown closely associated with vehicle 14 with cable 70 conveying digital feedback, it should be appreciated by those skilled in the art that converter 42 could optionally be closely associated with computer 69 with cable 70 conveying analog feedback instead. Either way, as vehicle 14 travels between well sites, the transducers travel with vehicle 14, while each well site has its own resident memory 48 and 54*d*

Figure 6:
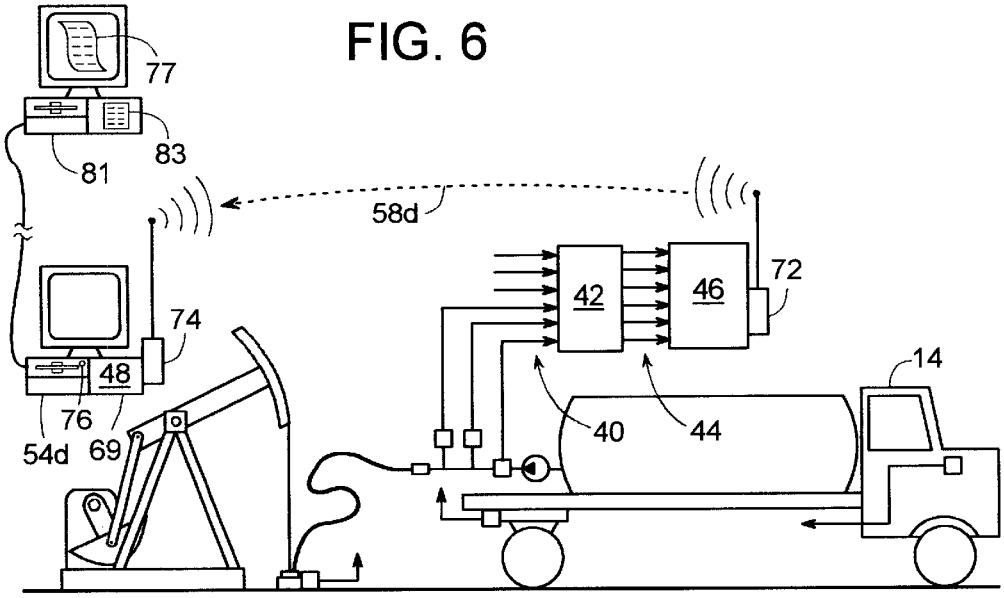
FIG. 6 is a schematic view of another embodiment.

The embodiment of FIG. 6 is similar to that of FIG. 5, however cable 70 is replaced by an electromagnetic communication link 58*d* provided by an electromagnet transmitter 72 and an electromagnetic receiver 74. However, it is well within the scope of the invention to switch the locations of transmitter 72 and receiver 74 depending on the resident location of memory 48 (i.e., at the well site or on the vehicle). The operation of this embodiment can vary, but in one example, transmitter 72 emits a radio signal that receiver 74 receives and computer 69 interprets as an indication that a specifically identified vehicle 14 has arrived at the well site. In response, computer 69 provides an indication (e.g. a green light) to the operator of the vehicle that his vehicle has been recognized and that computer 69 is ready to receive transducer feedback data. The operator performs the service operation on the well, while transducer feedback is transmitted to computer 69 for storage in memory 48.

The data is stored with limited access (e.g., lock and key and/or a computer password, all of which are depicted by numeral 76) for security purposes to prevent unauthorized tampering or altering of the data. In other words, those performing the service operation are inhibited from falsifying the data collected at the well site. Later, an owner of the well or a representative thereof with sufficient security clearance can access the stored data and use the information for a variety purposes including, but not limited to automatically creating an invoice 77 specifying the amount of payment due as a function of the data collected at the well site. A database memory 81 (e.g., a hard drive of a computer; a floppy disc; a CD (compact disk); ZIP drive/cartridge, an electronic chip such as RAM, EPROM, or EEPROM and variations thereof; and magnetic tape) stores data (i.e., plurality of digital feedback signals in reference to well site values) that has been collected over a period of days or years to provide a record 83 that serves as a history of the work performed at various wells. The use of invoice 77, database memory 81 and record 83 are optionally applicable to all embodiments of the invention.

Figure 7:
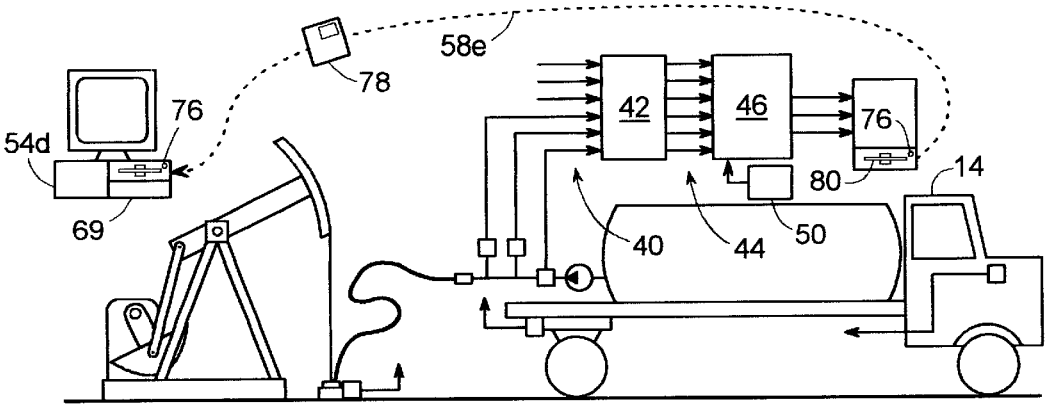
FIG. 7 is a schematic view of another embodiment.

The embodiment of FIG. 7 is similar to those of FIGS. 5 and 6; however, communication link 58*e* includes physically carrying a portable data storage element 78 between vehicle 14 and the well site. Portable data storage element 78 is schematically illustrated to represent the wide variety of forms that element 78 can assume, which include, but are not limited to a memory chip, such as RAM, EPROM, EEPROM and variations thereof; a magnetically recordable tape; a magnetically recordable disc such as a floppy disc; and a CD. The operation of this embodiment can vary, but in one example, transducer feedback is stored on a floppy disc at a disc drive 80. After the service operation is performed, the floppy disc with the transducer feedback data is then carried to computer 69 that is kept at the well site to serve as a well site identifier. Computer 69 reads and stores the transducer feedback data for later reference.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A well servicing system for a plurality of well sites being serviced by a service vehicle that is adapted to perform a first service operation at a first well site of said plurality of well sites and perform a second service operation at a second well site of said plurality of well sites, said first service operation and said second service operation being measurable by monitoring a parameter that varies in response to at least one of said first service operation and said second service operation being performed, said well servicing system comprising:

a transducer adapted to be kept resident with said service vehicle even as said service vehicle becomes relocated between said first well site and said second well site, said transducer being adapted to sense said parameter at said first well site and provide a first analog feedback signal that varies as a function of said parameter at said first well site, said transducer being adapted to sense said parameter at said second well site and provide a second analog feedback signal that varies as a function of said parameter at said second well site;

an analog to digital converter adapted to convert said first analog feedback signal and said second analog signal to a first digital feedback signal and a second digital signal respectively;

a first well site identifier at said first well site and being associated with a first digital well site value;

a second well site identifier at said second well site and being associated with a second digital well site value that is distinguishable from said first digital well site value;

a memory being adapted to store said first digital feedback signal and said first digital well site value in reference to each other and being adapted to store said second digital feedback signal and said second digital well site value in reference to each other; and a communication link that communicates at least one of said first digital feedback signal, said second digital feedback signal, said first digital well site value and said second digital well site to said memory, whereby said first service operation performed at said first well site can be distinguished from said second service operation performed at said second well site.

2. The well servicing system of claim 1, wherein said first well site identifier and said second well site identifier includes a bar code and said communication link includes a bar code scanner.

3. The well servicing system of claim 1, wherein said first well site identifier and said second well site identifier includes an electromagnetic element and said communication link includes an electromagnetic detector.

4. The well servicing system of claim 1, wherein each of said first well site identifier and said second well site identifier comprises a computer that includes said memory.

5. The well servicing system of claim 4, wherein said communication link includes a cable.

6. The well servicing system of claim 4, wherein said communication link includes an electromagnetic transmitter and an electromagnet receiver.

7. The well servicing system of claim 1, wherein said memory includes a memory chip.

8. The well servicing system of claim 1 further comprising a computer that includes a hard drive that provides said memory.

9. The well servicing system of claim 1, further comprising a computer and a portable data storage element, wherein said portable data storage element provides said memory with said computer being adapted to be read said portable data storage element.

10. The well servicing system of claim 1, wherein said communication link includes a portable data storage element to physically convey at least one of said first digital feedback signal and said first digital well site value to said memory.

11. The well servicing system of claim 10, wherein said portable data storage element includes a memory chip.

12. The well servicing system of claim 10, wherein said portable data storage element includes a magnetically recordable tape.

13. The well servicing system of claim 10, wherein said portable data storage element includes a magnetically recordable disc.

14. The well servicing system of claim 10, wherein said portable data storage element includes a CD.

15. The well servicing system of claim 1, wherein said parameter is at least one of a pressure, a temperature, a force, a rotational speed, and a rate of flow.

16. The well servicing system of claim 1, further comprising clock providing a digital time stamp that represents a time that said service operation is performed, said digital time stamp being stored in said memory, whereby said first service operation performed at said first well site can be further distinguished from said second service operation performed at said second well site by way of said time.

17. The well servicing system of claim 1, further comprising a first invoice at least partially based on said first digital feedback signal and said first digital well site value, and a second invoice at least partially based on said second digital feedback signal and said second digital well site value.

18. The well servicing system of claim 1, further comprising a database memory adapted to store a record containing said first digital well site value in reference to a plurality of first digital feedback signals and said second digital well site value in reference to a plurality of second digital feedback signals, wherein said plurality of first digital feedback signals and said plurality of said second digital feedback signals are collected over a period of days.

19. A well servicing system for a plurality of well sites being serviced by a service vehicle that is adapted to perform a first service operation at a first well site of said plurality of well sites and perform a second service operation at a second well site of said plurality of well sites, said first service operation and said second service operation being measurable by monitoring a parameter that varies in response to at least one of said first service operation and said second service operation being performed, said well servicing system comprising:

a transducer adapted to be kept resident with said service vehicle even as said service vehicle becomes relocated between said first well site and said second well site, said transducer being adapted to sense said parameter at said first well site and provide a first analog feedback signal that varies as a function of said parameter at said first well site, said transducer being adapted to sense said parameter at said second well site and provide a second analog feedback signal that varies as a function of said parameter at said second well site, said parameter being at least one of a pressure, a temperature, a force, a rotational speed, and a rate of flow;

an analog to digital converter adapted to convert said first analog feedback signal and said second analog signal to a first digital feedback signal and a second digital signal respectively;

a first well site identifier at said first well site and being associated with a first digital well site value, said first well site identifier including at least one of a first bar code and a first electromagnetic element;

a second well site identifier at said second well site and being associated with a second digital well site value that is distinguishable from said first digital well site value, said second well site identifier including at least one of a second bar code and a second electromagnetic element;

a memory being adapted to store said first digital feedback signal and said first digital well site value in reference to each other and being adapted to store said second digital feedback signal and said second digital well site value in reference to each other; and a communication link that includes at least one of a bar code scanner and an electromagnetic detector, said communication link communicating at least one of said first digital feedback signal, said second digital feedback signal, said first digital well site value and said second digital well site to said memory, whereby said first service operation performed at said first well site can be distinguished from said second service operation performed at said second well site.

20. The well servicing system of claim 19, wherein said first well site identifier and said second well site identifier includes a bar code and said communication link includes a bar code scanner.

21. A well servicing system for a plurality of well sites being serviced by a service vehicle that is adapted to perform a first service operation at a first well site of said plurality of well sites and perform a second service operation at a second well site of said plurality of well sites, said first service operation and said second service operation being measurable by monitoring a parameter that varies in response to at least one of said first service operation and said second service operation being performed, said well servicing system comprising:

a transducer adapted to be kept resident with said service vehicle even as said service vehicle becomes relocated between said first well site and said second well site, said transducer being adapted to sense said parameter at said first well site and provide a first analog feedback signal that varies as a function of said parameter at said first well site, said transducer being adapted to sense said parameter at said second well site and provide a second analog feedback signal that varies as a function of said parameter at said second well site, said parameter being at least one of a pressure, a temperature, a force, a rotational speed, and a rate of flow;

an analog to digital converter adapted to convert said first analog feedback signal and said second analog signal to a first digital feedback signal and a second digital signal respectively;

a first well site identifier at said first well site and being associated with a first digital well site value, said first well site identifier including a first bar code;

a second well site identifier at said second well site and being associated with a second digital well site value that is distinguishable from said first digital well site value, said second well site identifier including a second bar code;

a memory being adapted to store said first digital feedback signal and said first digital well site value in reference to each other and being adapted to store said second digital feedback signal and said second digital well site value in reference to each other; and a communication link that includes a bar code scanner and, said communication link communicating at least one of said first digital feedback signal, said second digital feedback signal, said first digital well site value and said second digital well site to said memory, whereby said first service operation performed at said first well site can be distinguished from said second service operation performed at said second well site.

* * * * *